US009151134B2

(12) United States Patent
Reimert et al.

(10) Patent No.: US 9,151,134 B2
(45) Date of Patent: Oct. 6, 2015

(54) SEAL ASSEMBLY AND METHOD

(75) Inventors: Larry E. Reimert, Houston, TX (US); Denise A. M. Antunes, legal representative, Houston, TX (US); Andrew J. Grohmann, Cypress, TX (US); Bruce J. Witwer, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 252 days.

(21) Appl. No.: 13/635,069

(22) PCT Filed: Jul. 8, 2011

(86) PCT No.: PCT/US2011/043296

§ 371 (c)(1),
(2), (4) Date: Mar. 21, 2013

(87) PCT Pub. No.: WO2012/047351

PCT Pub. Date: Apr. 12, 2012

(65) Prior Publication Data

US 2013/0206427 A1 Aug. 15, 2013

Related U.S. Application Data

(60) Provisional application No. 61/389,435, filed on Oct. 4, 2010.

(51) Int. Cl.
*E21B 33/04* (2006.01)
*E21B 33/00* (2006.01)

(52) U.S. Cl.
CPC ..... *E21B 33/04* (2013.01); *E21B 2033/005* (2013.01)

(58) Field of Classification Search
CPC ..... E21B 33/04; E21B 33/0422; E21B 33/03; E21B 2033/005
See application file for complete search history.

(56) References Cited

U.S. PATENT DOCUMENTS

| | | | | |
|---|---|---|---|---|
| 4,468,055 | A * | 8/1984 | Reimert | 285/123.4 |
| 4,719,971 | A * | 1/1988 | Owens | 166/191 |
| 4,757,860 | A | 7/1988 | Reimert | |
| 4,773,477 | A * | 9/1988 | Putch | 166/206 |
| 4,823,871 | A * | 4/1989 | McEver et al. | 166/182 |
| 4,911,244 | A * | 3/1990 | Hynes | 166/368 |
| 5,026,097 | A * | 6/1991 | Reimert | 285/123.4 |
| 5,076,356 | A | 12/1991 | Reimert | |
| 5,653,289 | A * | 8/1997 | Hosie et al. | 166/348 |
| 6,202,745 | B1 | 3/2001 | Reimert et al. | |
| 6,666,276 | B1 | 12/2003 | Yokley et al. | |
| 6,705,615 | B2 | 3/2004 | Milberger et al. | |
| 6,969,070 | B2 | 11/2005 | Reimert et al. | |
| 7,096,956 | B2 | 8/2006 | Reimert | |
| 8,517,089 | B2 * | 8/2013 | Galle et al. | 166/75.13 |

(Continued)

*Primary Examiner* — Jennifer H Gay
(74) *Attorney, Agent, or Firm* — Baker Botts L.L.P.

(57) ABSTRACT

A seal assembly (10) is provided for sealing between an interior surface (14) on a wellhead (12) and a tapered exterior surface (18) on a hanger (16). A unitary seal body (20) includes an upper portion for engagement with a force tool and a lower portion for sealing with the wellhead and the hanger. A first locking ring (24) is movable radially inward for securing the sealing assembly to the hanger, and a second locking ring (22) is movable radially outward for securing the seal assembly to the wellhead. An actuation member (60) including a plurality of downward extending fingers passing through slots in the seal body move downward through a portion of the body to force the first and second locking rings into engagement with the wellhead and the hanger.

20 Claims, 5 Drawing Sheets

(56) References Cited

U.S. PATENT DOCUMENTS

2010/0038089 A1* 2/2010 Gette et al. ..... 166/338
2010/0116489 A1* 5/2010 Nelson ..... 166/182
2010/0147533 A1* 6/2010 Nelson ..... 166/379
2010/0193195 A1* 8/2010 Nguyen et al. ..... 166/338
2013/0206427 A1* 8/2013 Reimert et al. ..... 166/387
2013/0213671 A1* 8/2013 Reimert et al. ..... 166/382

* cited by examiner

SEAL ASSEMBLY AND METHOD

CROSS REFERENCE TO RELATED APPLICATIONS

This application is a U.S. national stage application of PCT Appln. No. PCT/US11/43296 filed on Jul. 8, 2011, which claims the priority of U.S. Provisional Application No. 61/389,435 filed on Oct. 4, 2010, the disclosure of which is incorporated herein by reference for all purposes.

FIELD OF THE INVENTION

The present invention relates to seal assemblies suitable for sealing between a wellhead and a hanger, thereby sealing the casing within the wellhead. More particularly, the seal assembly disclosed herein is well suited for high temperature and high pressure applications to reliably seal the casing annulus.

BACKGROUND OF THE INVENTION

Various types of seal assemblies have been devised of the past fifty years for sealing between a casing hanger and a wellhead. Some seal assemblies are suitable for either high temperature or high pressure application, but not both high temperature and high pressure applications. Other seal assemblies are only suitable for modest temperature and pressure applications. Other seal assemblies initially form a seal, but over time lose their sealing effectiveness.

U.S. Pat. No. 6,705,615 discloses a seal assembly for sealing between a cylindrical surface and a tapered surface. Another type of seal assembly suitable for sealing between a cylindrical surface and tapered surface is disclosed in U.S. Pat. No. 6,666,276. A split carrier seal assembly for sealing between a sub-sea wellhead housing and a casing hanger is disclosed in U.S. Pat. No. 6,969,070. U.S. Pat. Nos. 4,757,860 and 5,076,356 and discloses another form of seal assembly for sealing between a cylindrical surface and a tapered surface.

U.S. Pat. No. 7,096,956 discloses a downhole tool for activating a seal assembly. U.S. Pat. No. 6,202,745 discloses a casing hanger positioned within a wellhead.

Most downhole wellhead-hanger seal assemblies are manufactured from two or more components which make up the seal body which supports one or more seals that seal with the wellhead and the hanger. In many cases, these components are interconnected by threads, which inherently allow axial travel between components. This axial travel between seal body components allows travel and thus wear on both the seals and the sealing surfaces. High seal setting forces are also conventionally difficult to transmit through a seal body with threaded components.

Another significant problem with prior art sealing assemblies is that when fluid pressure is applied from below the set seal assembly, the interior wellhead wall expands radially outward, and the exterior hanger wall contracts radially inward, thereby creating a significant increase in the radial gap, which inherently detracts from sealing effectiveness. The disadvantages of this created gap are particularly significant when high downhole pressure is applied from below the seal assembly.

The disadvantages of the prior art are overcome by the present invention, and an improved seal assembly and method are hereinafter disclosed.

SUMMARY OF THE INVENTION

In one embodiment, a seal assembly is provided for sealing between an interior surface on a wellhead and an exterior surface on a hanger positioned within the wellhead. In this embodiment, the seal assembly comprises a unitary body including an upper portion for engagement with a force tool to set the seal assembly, and a lower portion with one or more radially internal seals for sealing with the exterior hanger surface and one or more radially exterior seals for sealing with the wellhead surface. A first C-shaped locking member supported on the unitary body is radially movable inward for securing the seal assembly to the hanger, and a second C-shaped locking member supported on the unitary body is radially movable outward for securing the seal assembly to the wellhead. An actuation member axially movable downward through a portion of the unitary body forces the second locking ring radially outward for engagement with the wellhead and forces the first locking ring radially inward for engagement with the hanger.

In another embodiment, a seal assembly is provided for sealing between the interior surface on a wellhead and the exterior surface on a hanger positioned within the wellhead. The seal assembly when in use withstands a rated high fluid pressure from below the seal assembly which forces a portion of the interior surface of the wellhead radially outward by an expansion amount and forces a portion of the exterior surface of the hanger radially inward by a compression amount. The seal assembly includes a seal body with an upper portion for engagement with the force tool, a lower portion with one or more radially internal seals for sealing with the exterior hanger surface and one or more radially external seals for sealing with the interior wellhead surface. During installation of the seal assembly, a lower portion of the seal body forces a portion of the interior surface of the wellhead engaged by the lower portion of the seal body radially outward by at least substantially the expansion amount, and forces a portion of the exterior surface of the hanger radially inward by at least substantially the compression amount, thereby effectively preloading both the wellhead and the hanger at substantially the equipment rated fluid pressure to fluid pressure from below.

These and further features and advantages of the present invention will become apparent from the following detailed description, wherein reference is made to the figures in the accompanying drawings.

DETAILED DESCRIPTION OF PREFERRED EMBODIMENTS

Figure 1:
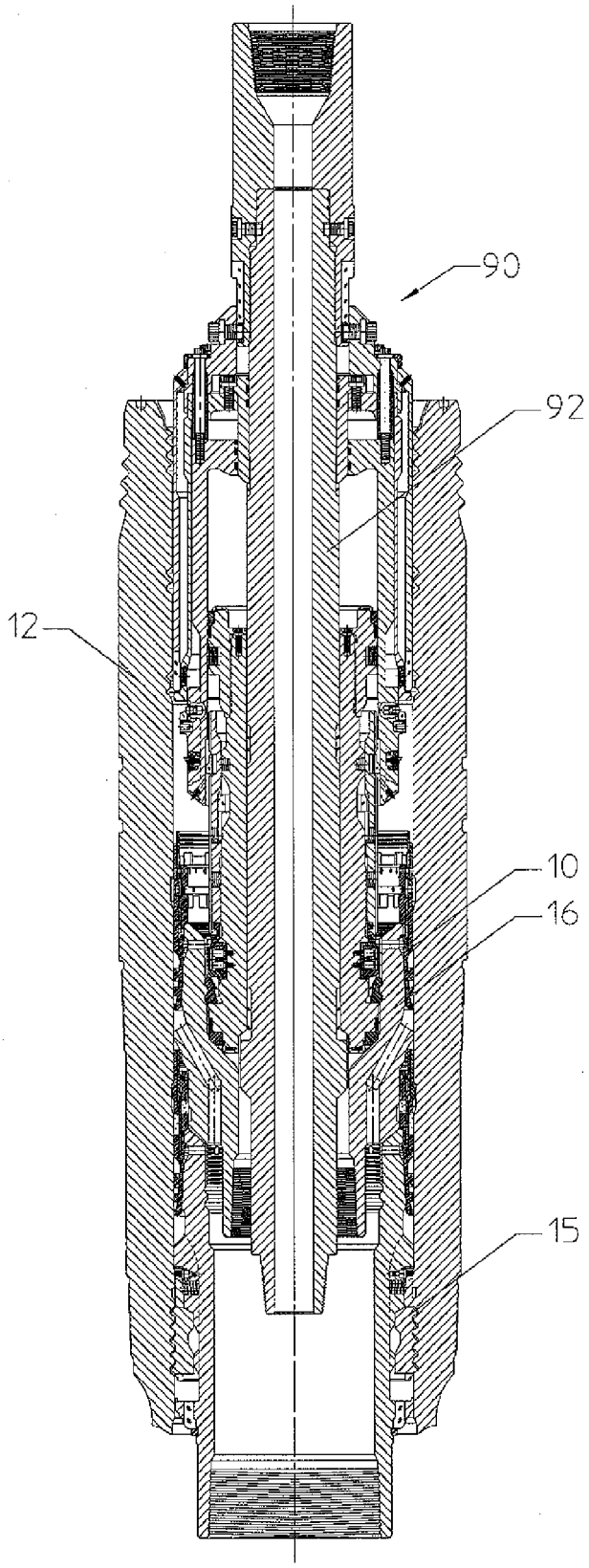
FIG. 1 is a sectional view of a wellhead, a casing hanger, and a seal assembly for sealing between a wellhead and the casing hanger.
Figure 2:
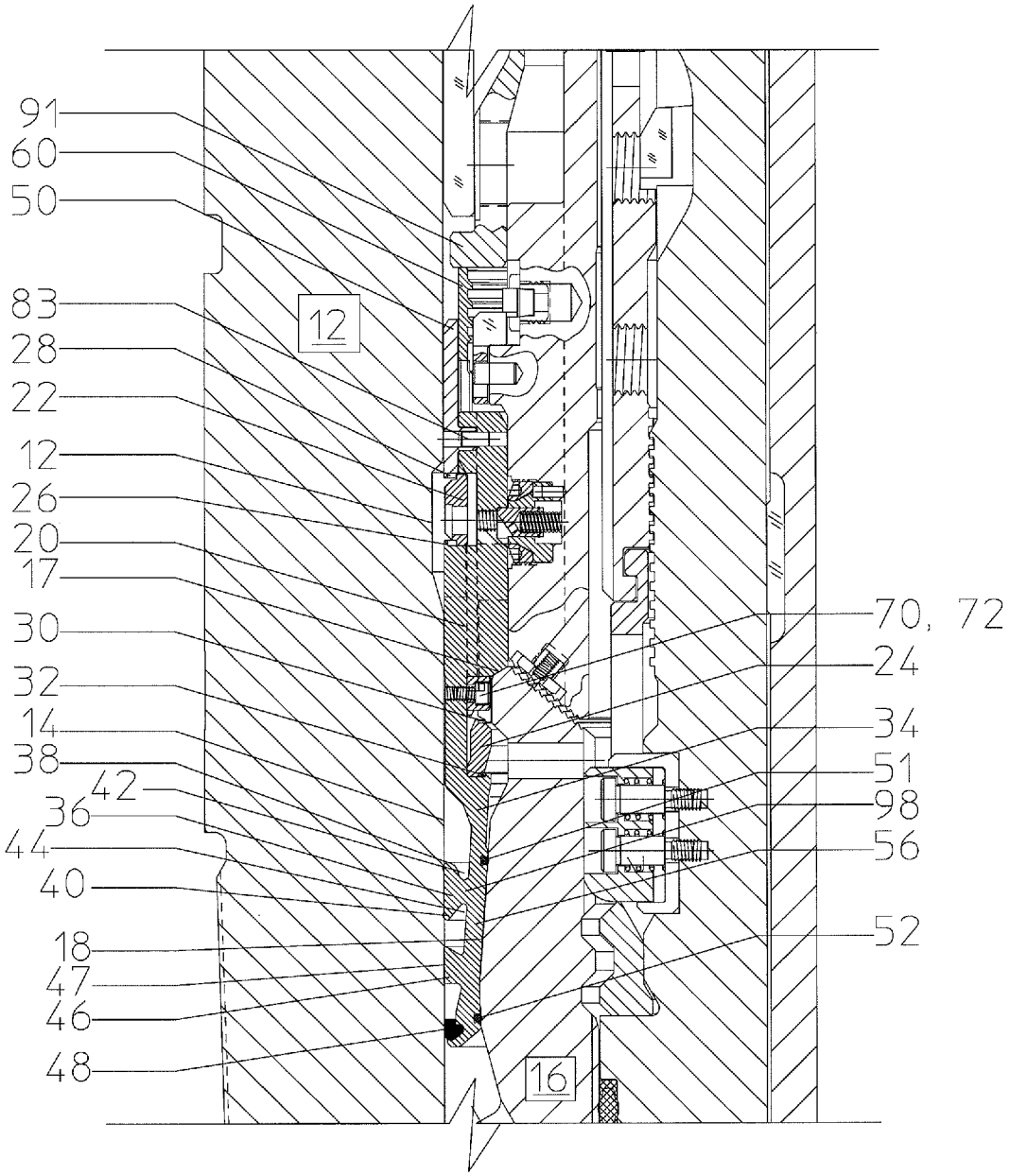
FIG. 2 is an enlarged view of a seal assembly set but not locked to the hanger.

Referring to FIGS. 1 and 2, a seal assembly 10 is shown supported on shoulder 17 of a casing hanger 16 positioned within a wellhead 12. C-ring 15 may be used to connect the hanger 16 to the wellhead 12. The wellhead includes an inner generally cylindrical surface 14, while the casing hanger includes a tapered outer surface 18. The seal assembly 10 seals between these surfaces. Seal body 20 is a unitary and preferably homogeneous component, and as shown in FIG. 2 supports locking ring 22 for positioning within a groove in the wellhead 12 to lock the seal assembly to the wellhead, and another locking ring 24 for positioning within a groove to lock the seal assembly to the casing hanger 16. Actuator sleeve 60 is discussed further below, and is forced downward by the lower end of a fluid pressure actuated force tool 90 as shown in FIG. 1 to move locking ring 22 radially outward and to move the locking ring 24 radially inward. A suitable running and force tool is of the type disclosed in U.S. Pat. No. 7,906,956.

Referring still to FIG. 2, the seal assembly 10 is shown in detail. The upper portion of the unitary body 20 includes an annular stop 26 for engagement with a lower portion of the C-ring 22 to prevent the C-ring from moving radially outward beyond the movement required to position the locking ring within the groove in the wellhead. Sleeve 50 discussed subsequently includes a similar annular locking member 28 for engagement with the upper portion of the seal ring 22 for preventing the ring 22 from moving radially outward beyond an acceptable range. Similarly, the locking ring 24 which locks with the casing hanger 16 is prevented from moving radially inward by the annular stop 32 on the body 20, while a retainer ring 54 shown in FIG. 3 engages an upper portion of the locking ring 24 to limit radially inward movement of the locking ring 24.

Figure 3:
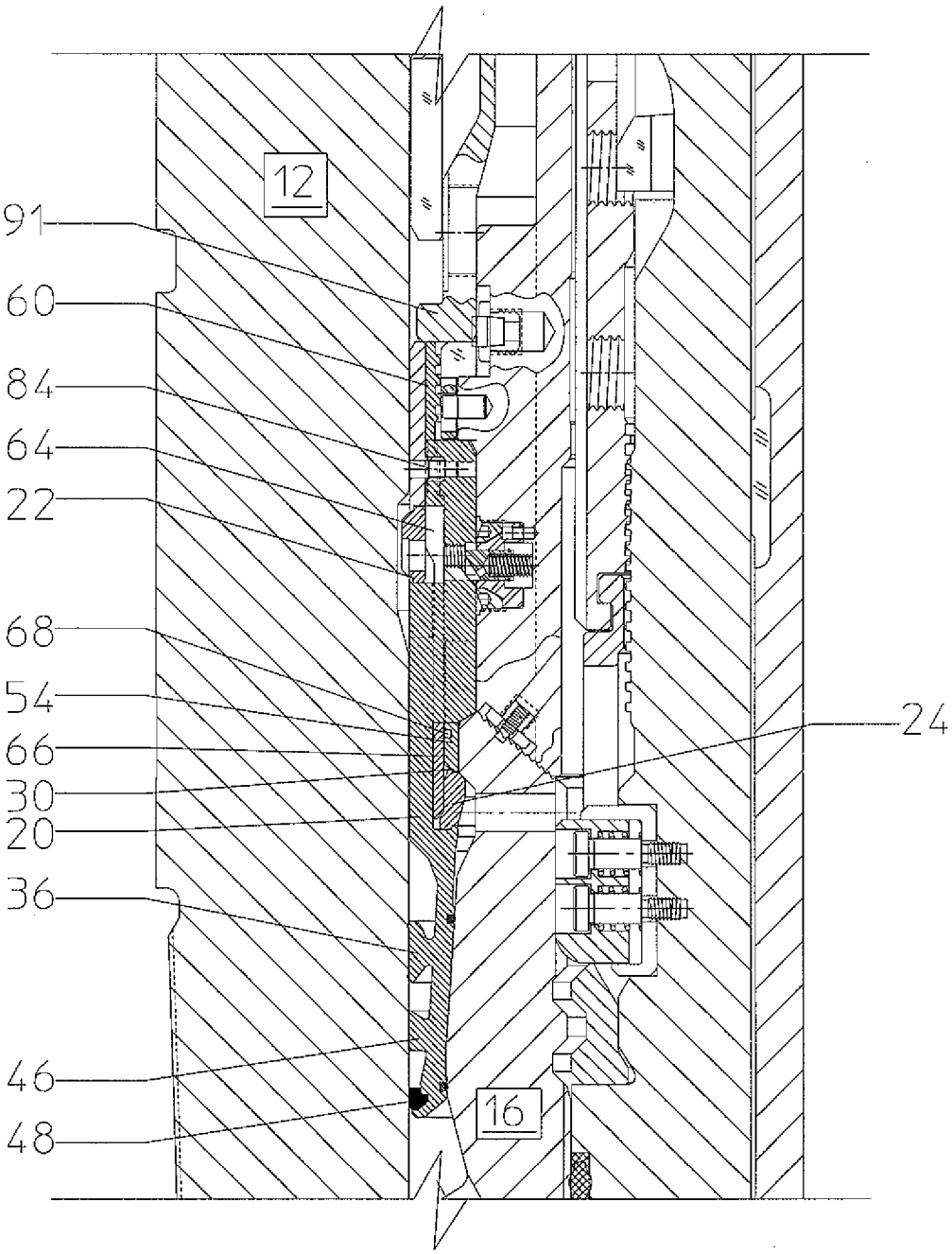
FIG. 3 shows the seal assembly in FIG. 2 locked to both the wellhead and the casing hanger, and the lower portion of the seal assembly in sealing engagement with both the casing hanger and the wellhead.

The lower portion 34 of the seal body includes a base 56 and a radially outward projecting member 36, which has annular bumps 38 and 40 at its upper and lower ends for sealing engagement with the interior surface 14 on the wellhead 12. A gap 42 between a portion of the projecting member 36 and the base 56 provides for limited outward deflection of the bump 38 at the upper end of member 36 when pressure is applied to the seal assembly from above, while a similar gap 44 allows limited outward deflection of annular bump 40 when fluid pressure is applied to the seal assembly from below. FIG. 2 also depicts seals 51 and 52 on the inner surface of the seal body each formed from an annular metal bump for sealing engagement with the tapered surface 18 of the hanger 16. As shown in FIGS. 2 and 3, gaps along the radially inner surface at the lower portion of body 20 may each be filled with an elastomeric O-ring 51, 52 which provides for low pressure or initial sealing engagement with the exterior surface of the casing hanger.

In the FIG. 2 embodiment, a protector element 46 is spaced below the projecting member 36 and provides a radially outer surface 47 which acts as a protector to eliminate or at least minimize damage to the projecting member 36 when the seal assembly is pushed between the cylindrical surface on wellhead 12 and the tapered surface on the hanger 16, since the outer diameter of element 46 is substantially as large as the outer diameter of projecting member 36. Being positioned lower than projecting member 36, element 46 thus contacts the interior wall 14 of the wellhead housing when the seal assembly is pressed in place. The element 46 also serves to prevent crushing of the seal body when fluid pressure from above the set seal assembly acts to force the seal body radially outward. High pressure from above the seal assembly could deform the seal body such that, when this high pressure from above the seal assembly is removed, the seal assembly would leak. Element 46 acts to withstand a high radially outward force on the seal body to prevent the sealing surfaces from being crushed so that the seal assembly no longer seals. Even though the forces tending to create a gap and detract from sealing effectiveness are greater when fluid pressure is from below, the seal assembly preferably is able to reliably seal while withstanding a high fluid pressure from below and also a high fluid pressure from above.

FIG. 2 also discloses a puller mechanism 48 for initially sealing with the interior surface of the wellhead, such that fluid pressure above the puller member pulls the seal assembly downward. Most importantly, the puller mechanism 48 creates an initial seal which allows pressure buildup so that the force tool pushes the seal assembly into the final set position. Further details regarding a seal puller mechanism are disclosed in U.S. Pat. No. 6,705,615.

To set the seal assembly, the running and force tool 90 may first be rotated by the work string to release the running tool from the hanger. A sleeve rotates with the tool mandrel such that threads cause the sleeve to move axially upward during this rotation, which allows a C-ring to radially collapse. The C-ring thus moves radially inward and out of engagement with the internal locking grooves on the casing hanger to release the hanger from the tool 90.

The running tool may be further rotated to move the sleeve further upward, thereby releasing the seal assembly 10 from the tool 90 to drop to a preset position. The seal assembly 10 and the running tool mandrel 92 move independently down, with the seal assembly in the annulus between the upper enlarged OD of the hanger and the ID of the wellhead. At this stage, the BOP conventionally positioned on top of the wellhead may be closed, and fluid pressure exerted on the force tool 90 through the running string to drive the seal assembly 10 further downward from its preset position to its final sealing position.

Figure 4:
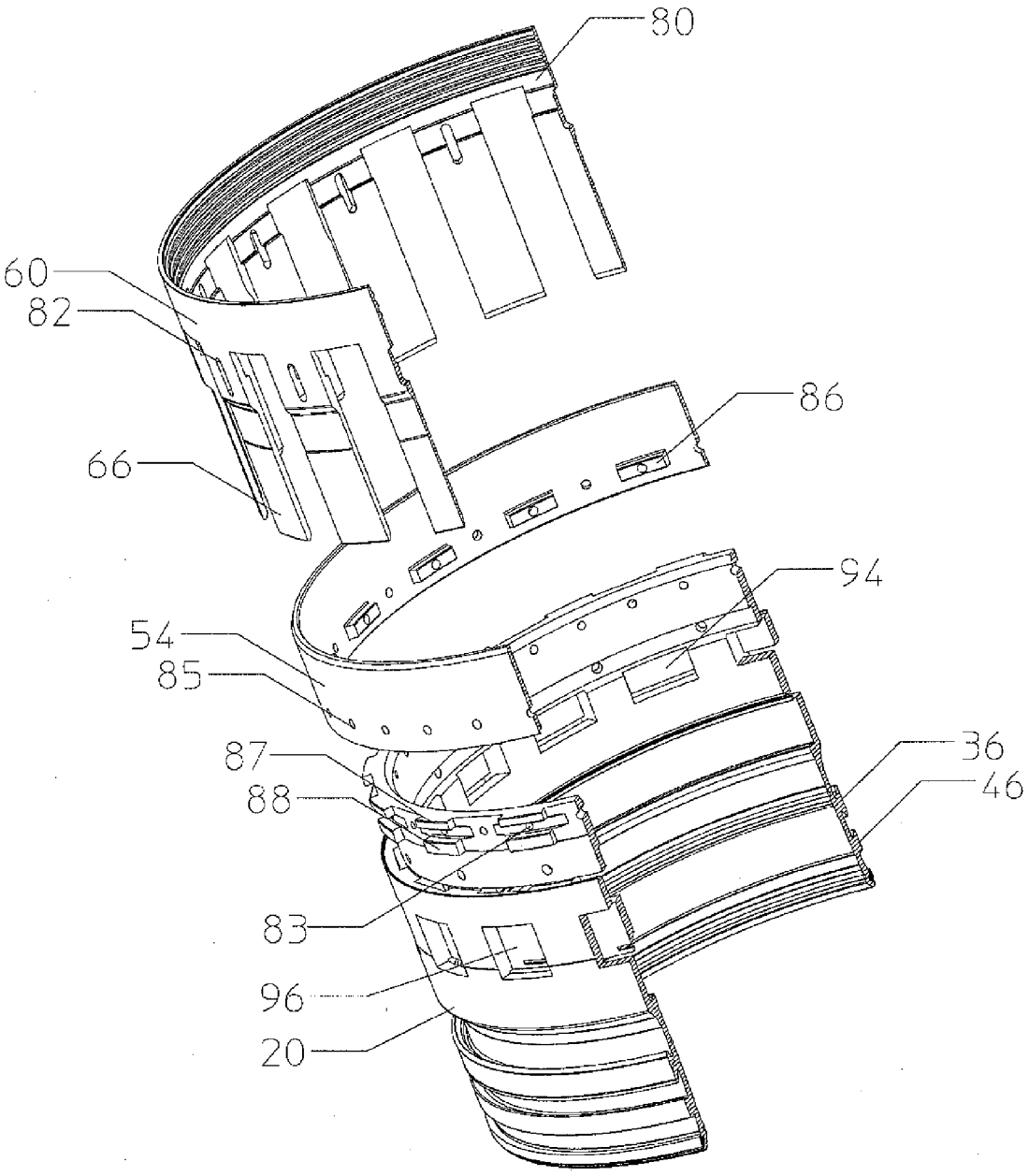
FIG. 4 is a pictorial view, partially in cross-section, illustrating the upper components of the seal assembly shown in FIGS. 2 and 3.

Referring now to FIG. 3, the actuator sleeve 60 has been forced downward from the FIG. 2 position by the lower tool force mechanism 91 of the force tool 90. This action forces a large diameter surface 64 on the actuator sleeve 60 to engage the C-ring 22, forcing the C-ring radially outward and into a slot provided in the wellhead. The actuating sleeve 60 has downward extending fingers 66, as shown in FIG. 4, which also engage the locking ring 24 to lock this ring into a suitable groove provided in the exterior surface of the casing hanger. Surface 64 which presses the ring 22 outward may be provided on the downwardly extending fingers. Radial movement of each locking ring is restricted by the seal body and the annular stops 26, 28, 30, and 32 discussed above.

During assembly of the locking ring 24 within the seal body 20, the split C-ring 24 may first be installed in the radially outward position, and the split retaining ring 54 then supported on the unitary body 20. Ring 54 includes an annular retainer 30 for engaging an upper portion of the locking ring 24 to limit radially inward movement of the locking ring. Ring 54 may be installed on stop member 68 formed as part of the seal body 20, so that the retainer ring 54 is axially affixed to the seal body by the stop member and does not exert a downward force on the C-ring 22. Once the C-ring 54 is installed, a spacer member may be secured by a bolt to the body 20, and fills the space between the ends of the C-ring to prevent the ring 54 from collapsing inward, thereby retaining the C-ring 24 into position on the seal body.

FIG. 4 depicts the seal body 20, the actuation sleeve 60, and the retaining ring 54 discussed above. The upper portion 80 of the actuation sleeve 60 is thus ring shaped, with fingers 66 extending downward. Each finger is provided with a slot 82 which receives a pin, which limits travel of the actuation sleeve in the downward direction, and also allows the seal assembly 10 to be returned to the surface with the actuation sleeve 60.

FIG. 4 also depicts the retaining ring 54, which includes a plurality of lugs 86 protruding inward from an inner surface of the sleeve 54. These lugs cooperate with circumferentially spaced upper and lower stops 87, 88 on the seal body 20, so that each lug is positioned between a respective upper stop 87 and the respective lower stop 88 on the seal body 20. Holes 85 in the sleeve 54 allow the sleeve to be rotationally locked to the body 20 with a suitable pin passing through the hole 83 in the body 20, so that removal of the pins is required to remove the sleeve 54 from the seal body. The sleeve 54 is thus locked in place and is rotationally and axially secured to the body 20.

The seal body 20 includes circumferentially spaced upper slots 94 and aligned lower slots 96. Slots 94 are formed radially outward from the inner surface of body 20, while slots 96 are formed radially inward from the outer surface of the body 20. A slight radial overlap of these slots allows a respective finger 66 to axially slide through the body, with each finger passing through a portion of an upper slot and a portion of a lower slot, while still maintaining the desired strength of the body 20 to withstand the forces driving the seal body downward. Projecting member 36 and protective member 46 are also shown at the lower end of the seal body 20.

Figure 5:
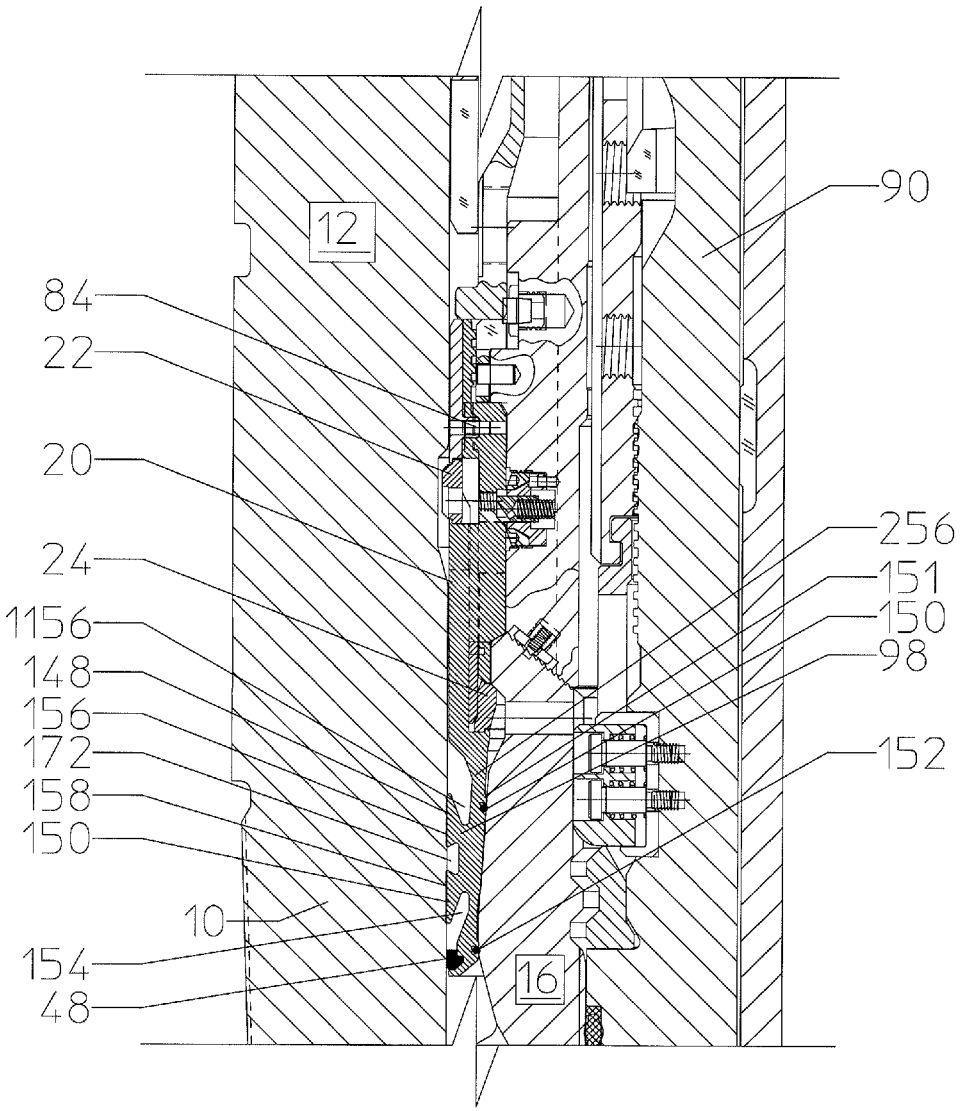
FIG. 5 illustrates another embodiment of a seal assembly according to this invention.

Referring now to FIG. 5, the upper portion of the seal assembly 10 and the force tool 90 are similar to the seal assembly and tool previously discussed. The seal assembly preferably includes locking C-rings 22 and 24. The lower portion of the seal body 20 includes a metal base 256 and one or more elastomeric seals 150, 152 as discussed above for sealing engagement with the tapered exterior surface of casing hanger 16. The elastomeric seals 150, 152 are optional, since the raised annular protrusions or bumps 151 on the radially inner surface of the seal body above and below each elastomeric seal forms a reliable metal-to-metal seal with the casing hanger.

A first outer metal member 148 on the seal body 20 projects radially outwardly and upwardly from the seal body base 256 and forms a first gap 1156 exposed to fluid pressure above and radially outward of the seal assembly. The first gap is radially between the seal body base and the upwardly projected member. A second outer metal member 150 projects radially outwardly and downwardly from the seal body base 256 and forms a second gap 154 open to fluid pressure below and radially outward of the seal assembly. The second gap is radially between the seal body base and the downwardly projecting member. Each of the metal members 148 and 150 has an exterior surface 156, 158, respectively, which is substantially parallel to an interior surface of the wellhead. This exterior surface preferably extends along an axial length greater than a maximum radial width of the respective metal member.

FIG. 5 also illustrates raised annular bumps 151 on the inner surface of the seal body, with the raised bumps optionally spaced above and below an annular groove for receiving an elastomeric seal. The raised bumps provide final sealing with the casing hanger, and are significantly flattened by the high force which presses the seal assembly downward, coupled with the relatively low angle on the exterior surface of the casing hanger. This angle most applications will be less than about 7°, and for many applications will be from 4°-5°. In many applications, the radial forces exerted by the seal assembly on the wellhead interior surface and on the casing hanger exterior surface will be several million pounds, thereby effectively preloading the wellhead and the hanger so that equipment rated fluid pressure from below the seal assembly causes little or no further gap separation between these surfaces, thereby maintaining a reliable seal.

The running and force tool 90 moves the seal body downward from its released and preset position to its set position, i.e., its final axial position wherein the seal body exerts the desired force to move a portion of the wellhead inner surface radially outward, and to move a portion of the hanger outer surface radially inward, thereby preloading both the wellhead and the hanger at the axial location of the engaging surfaces on the seal body. The seal body remains in this axial position while sealing the casing annulus, although the upwardly and downwardly projecting members 38 and 40, or the modified fingers as shown in FIG. 5, respond to fluid pressure to further energize the seal assembly.

FIG. 5 also depicts an annular gap 172 between the upper metal member 148 and lower metal member 150. This annular gap is shown in FIG. 5 as a substantially dove-tailed configuration, and provides both debris receptacle to increase sealing effectiveness and provides further elasticity to promote the radially outward movement of the outer surface 156, 158 of each metal member. Puller member 48 similar to that shown in FIG. 3 may be provided at the lower end of the seal body. The cantilevered tip of each member 148 and 150 may be provided with a slight bulbous end, so that this end surface provides initial sealing with the wellhead surface. When the substantial setting forces are applied to the seal assembly, this bulbous end quickly flattens out such that the planar surface of the members 148 and 150 provides effective sealing engagement with the wellhead.

FIGS. 3 and 5 also illustrate a substantial radial overlap between the interior surface of the seal assembly and the exterior surface of the casing hanger, and between the exterior surface of the seal assembly and the interior surface of the wellhead. Those skilled in the art appreciate that this overlap obviously cannot occur, but this depiction is useful to indicate the extent to which the casing hanger, and the wellhead are each deflected in response to the high seal setting forces.

Radial deflection of the wellhead inner surface and the hanger outer surface due to the action of the force tool acting on the seal assembly preferably causes radial deflection of the wellhead and hanger which is substantially equal to or greater than the radial deflection which otherwise occurs on these surfaces in response to fluid pressure at the rated pressure from below the seal assembly. To obtain the significant benefits of a preloading, the preloading force on the wellhead inner surface and the hanger outer surface is at least 70% of the fluid pressure deformation of these surfaces caused by fluid pressure at the rated pressure for the seal assembly. In many applications, preload deformation of these surfaces through the force tool and seal assembly will be at least 80% of the deformation caused by fluid pressure at the rated pressure level.

The seal body 20 is used to perform the preloading function, and this objective is accomplished by providing an outer seal body surface which engages the wellhead inner surface and an inner seal body surface which engages the hanger outer surface. The substantial forces exerted on the seal body thus brings the inner surface of the seal body into engagement with the hanger, even though seals 51 and 52 may initially extend outward from the inner surface of the seal body. A solid portion 98 of the seal body thus extends in a pure radial direction from an outer surface which engages the wellhead to an inner surface which engages the hanger, since a solid mass between these surfaces allows the seal body to withstand the high forces generated by the force tool and the force multiplier due to the taper of the exterior surface of the hanger.

The seal assembly as disclosed herein is particularly well suited for sealing between an interior surface of a wellhead and an exterior surface of a hanger positioned within the wellhead. The seal assembly is particularly well suited for subsurface applications, although the seal assembly may also be used to seal between a surface wellhead and a hanger positioned within the surface wellhead. In this latter application, a running string may be a relatively short tubular for positioning the seal assembly within the surface wellhead. Various types of actuation members may be used for activating the seal assembly.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A seal assembly for sealing between an interior surface on a wellhead and an exterior tapered surface on a hanger positioned within the wellhead, the seal assembly comprising:

a unitary body including an upper portion for engagement with an actuation member for moving the unitary body axially downward to a set position, the unitary body including a lower portion with one or more radially internal seals for sealing with the exterior hanger surface and one or more radially exterior seals for sealing with the interior wellhead surface;

a first C-shaped locking ring supported on the unitary body and radially movable inward for securing the seal assembly to the hanger;

a second C-shaped locking ring supported on the unitary body and radially movable outward for securing the seal assembly to the wellhead; and the actuation member axially movable downward through a portion of the unitary body to force the second locking ring radially outward for engagement with the wellhead and to force the first locking ring radially inward for engagement with the hanger, the actuation member including a plurality of downward extending fingers spaced circumferentially about the actuation member and passing through circumferentially spaced slots in the unitary body to engage the first locking ring.

2. A seal assembly as defined in claim 1, further comprising:

a plurality of radially inward cutouts in the unitary body each forming a slot for receiving one of the plurality of fingers.

3. A seal assembly as defined in claim 1, further comprising:

a plurality of radially outward cutouts in the unitary body each forming a slot for receiving one of the plurality of fingers.

4. A seal assembly as defined in claim 1, further comprising:

the unitary body including a first retainer for engagement with a lower portion of the first locking ring to limit radially inward movement of the first locking ring; and the unitary body including a second retainer for engagement with a lower portion of the second locking ring to limit radially outward movement of the second locking ring.

5. A seal assembly as defined in claim 4, further comprising:

a retainer ring supported on the unitary body for engagement with an upper portion of the first locking ring to limit radially inward movement of the first locking ring.

6. A seal assembly as defined in claim 5, further comprising:

the retainer ring is axially fixed to the unitary body.

7. A seal assembly as defined in claim 5, further comprising:

the retainer ring is C-shaped with opposing ends; and a spacer acting between the opposing ends of the retainer ring to prevent the retainer ring from inadvertently collapsing.

8. A seal assembly as defined in claim 4, further comprising:

a sleeve supported on the unitary body and having a sleeve retainer for engagement with an upper portion of the second locking ring to limit radially outward movement of the second locking ring.

9. A seal assembly as defined in claim 1, wherein the one or more radially internal seals on the unitary body are annular metal bumps on a radially inner surface of the unitary body.

10. A seal assembly as defined in claim 1, further comprising:

a puller member supported on the lower portion of the seal body for initially sealing with the interior surface on the wellhead, such that fluid pressure above the puller member pulls the seal assembly downward.

11. A seal assembly for sealing between an interior surface on a wellhead and an exterior tapered surface on a hanger positioned within the wellhead, the seal assembly when in use withstanding a rated high fluid pressure from below the seal assembly and between the interior wellhead surface and the exterior hanger surface, the rated high fluid pressure below the seal assembly forcing a portion of the interior surface of the wellhead below the seal assembly radially outward by an expansion amount and forcing a portion of the exterior surface on the hanger radially inward by a compression amount, the seal assembly further comprising:

a seal body including an upper portion for engagement with an actuation member for moving the seal body axially downward to set the seal assembly, the seal body including a lower portion with one or more radially internal seals for sealing with the exterior hanger surface and one or more radially exterior seals for sealing with the interior wellhead surface; and the lower portion of the seal body engaging the exterior tapered surface on the hanger and forcing a portion of the interior surface of the wellhead radially outward by at least substantially the expansion amount and forcing a portion of the exterior surface of the hanger radially inward by at least substantially the compression amount;

the seal body including a first retainer for engagement with a lower portion of a first locking ring to limit radially inward movement of the first locking ring; and the seal body including a second retainer for engagement with a lower portion of a second locking ring to limit radially outward movement of the second locking ring.

12. A seal assembly as defined in claim 11, wherein the lower portion of the seal body includes a protector member.

13. A seal assembly as defined in claim 11, further comprising:

a puller member supported on the lower portion of the seal body for initially sealing with the interior surface on the wellhead, such that fluid pressure above the puller member pulls the seal assembly downward.

14. A seal assembly as defined in claim 11, further comprising:

a retainer ring supported on the seal body for engagement with an upper portion of the first locking ring to limit radially inward movement of the first locking ring.

15. A seal assembly as defined in claim 11, wherein the one or more radially internal seals on the unitary body are annular metal bumps on a radially inner surface of the unitary body.

16. A method of sealing between an interior surface on a wellhead and a tapered exterior surface on a hanger positioned within the wellhead, the seal assembly when in use withstanding a rated high fluid pressure from below the seal assembly and between the interior wellhead surface and the exterior hanger surface, the rated high fluid pressure below the seal assembly conventionally forcing a portion of the interior wellhead surface radially outward by an expansion amount and conventionally forcing a portion of the exterior hanger surface radially inward by an expansion amount, the method comprising:

providing a seal body including an upper portion for engagement with a force tool and a lower portion with one or more radially internal seals for sealing with the exterior hanger surface and one or more radially exterior seals for sealing with the interior wellhead surface; and during installation of the seal assembly, forcing the seal body downward such that the lower portion of the seal body engages the tapered exterior surface on the hanger and, in response to the force tool, forces a portion of the interior surface of the wellhead engaged by the lower portion of the seal assembly radially outward by at least substantially the expansion amount and forces a portion of the exterior surface of the hanger engaged by the lower end of the seal assembly radially inward by at least substantially the expansion amount;

providing a first retainer on the seal body for engagement with a lower portion of a first locking ring to limit radially inward movement of the first locking ring; and providing a second retainer on the seal body for engagement with a lower portion of a second locking ring to limit radially outward movement of the second locking ring.

17. A method as defined in claim 16, further comprising:

providing a protection member on the lower portion of the seal body.

18. A method as defined in claim 16, further comprising:

supporting a puller member on the lower portion of the seal body for initially sealing with the interior surface on the wellhead, such that fluid pressure above the puller member pulls the seal assembly downward.

19. A method as defined in claim 16, further comprising:

supporting a retainer ring on the seal body for engagement with an upper portion of the first locking ring to limit radially inward movement of the first locking ring.

20. A method as defined in claim 19, further comprising:

fixing the retainer ring circumferentially to the seal body.

* * * * *